US005487674A

United States Patent [19]

Guzik et al.

[11] Patent Number: 5,487,674

[45] Date of Patent: Jan. 30, 1996

[54] SURFACE MOUNTABLE LEADED PACKAGE

[75] Inventors: Andrzej T. Guzik, Pompano Beach; Todd L. Smith; Jeffrey P. Marchuk, both of Ft. Lauderdale, all of Fla.

[73] Assignee: Motorola, Inc., Schaumburg, Ill.

[21] Appl. No.: 85,806

[22] Filed: Jul. 6, 1993

[51] Int. Cl.[6] ..... H01R 4/02

[52] U.S. Cl. ..... 439/83

[58] Field of Search ..... 493/78, 79, 80, 493/83, 635, 637; 29/842, 844, 882; 439/381, 108

[56] References Cited

U.S. PATENT DOCUMENTS

| | | | |
|---|---|---|---|
| Re. 29,223 | 5/1977 | Pritulsky | 439/635 X |
| 2,711,523 | 6/1955 | Willis | 439/635 X |
| 4,176,900 | 12/1979 | Hines et al. | 439/635 X |
| 4,536,955 | 8/1985 | Gudgeon | 439/83 X |
| 4,721,472 | 1/1988 | Gentry et al. | 439/79 |
| 4,875,863 | 10/1989 | Reed | 439/79 |
| 5,128,834 | 7/1992 | Kaschke | 361/417 |
| 5,133,670 | 7/1992 | Doi et al. | 439/79 |
| 5,346,404 | 9/1994 | Shimada | 439/108 |

FOREIGN PATENT DOCUMENTS

| | | | |
|---|---|---|---|
| 2537512 | 2/1977 | Germany | 439/637 |
| 3133070 | 6/1991 | Japan | 439/79 |
| 2251128 | 6/1992 | United Kingdom | 439/78 |

*Primary Examiner*—Gary F. Paumen
*Attorney, Agent, or Firm*—Andrew S. Fuller

[57] ABSTRACT

A method and an apparatus provide a surface mountable package (100) with leads (150) having free end portions (355) coplanar in a target plane (370). The method includes forming the leads (150) such that the free end portions (355) angle away from the target plane (370), and biasing the free end portions (355) against a biasing surface (365) integral to the package (100) such that the free end portions (355) are forced toward the target plane (370) and into a coplanar state. The apparatus includes a housing (110), a plurality of leads (150) with free end portions (355) preformed to angle away from the target plane (370) mounted onto the housing (110), and a biasing surface (365), located on the package (100), to bias the free end portions (355) toward the target plane (370).

2 Claims, 3 Drawing Sheets

SURFACE MOUNTABLE LEADED PACKAGE

TECHNICAL FIELD

This invention relates in general to electrical components, and in particular, to the maintenance of coplanar leads on a surface mounted leaded electrical or mechanical package.

BACKGROUND

As manufacturers of electronic devices seek to implement more efficient manufacturing processes, there has been a corresponding increase in the use of surface mounting in assembly operations. A typical electronic device may contain one or more circuit boards on which electrical and mechanical components are mounted. Many electrical components, such as power amplifiers and microprocessors, and some electro-mechanical components, such as connectors, are housed in packages which include leads to provide electrical connection from the component to the circuit board. Traditionally, leaded packages were mounted to a circuit board using through hole mounting techniques, which is well-suited to accommodate leads. Surface mounting technology has now replaced through hole mounting in many applications, in part to facilitate automation. However, there are certain problems associated with surface mounting leaded packages, especially when these leaded packages are surface mounted on a cladded printed circuit board. One such problem involves maintaining coplanarity among the leads on the leaded package.

Coplanarity exists among the leads on a package when the contact surfaces of the leads are substantially on the same plane. In a surface mounting operation, coplanarity is necessary to ensure that all the leads of the package make electrical contact with corresponding interface connections on the circuit board. A lack of coplanarity may be caused by several sources. For example, a leaded package manufacturer may be unable to consistently produce coplanar leads. Moreover, leads on a package may lose their coplanarity during normal handling. Consequently, defects may occur in an electronic device manufactured using non-coplanar leaded packages. For example, a leaded package will typically be soldered to a circuit board thereby becoming part of the electronic circuitry for the electronic device. If the leads on the package are even slightly non-coplanar, the package may be improperly seated on the circuit board thus causing poor or non-existent solder connections between the package and the circuit board. The result is an electronic device which may be defective and which will be more susceptible to mechanical and thermal stress failures.

A lack of lead coplanarity on surface mounted leaded packages is a major source of defects for many manufacturing operations. As more leaded packages are adapted for surface mounting, the need to eliminate coplanarity problems increases. The use of surface mounting in manufacturing can result in an improvement in manufacturing efficiency. Additionally, an improvement in product quality can be realized if the problem of lack of coplanarity of leaded packages can be addressed. Therefore, there exists a need for a new package design which addresses the coplanarity problem thereby facilitating the use of surface mounting.

SUMMARY OF THE INVENTION

Briefly, in accordance with the invention, a method and an apparatus are described which provide a surface mountable package with leads coplanar in a target plane. The leads have a fixed end attached to the surface mountable package and an unattached free end portion. The steps include forming the leads such that the free end portions angle away from the target plane, and biasing the free end portions against a biasing surface integral to the package such that the free end portions are forced toward the target plane and into a coplanar state. The apparatus includes a housing, a plurality of leads mounted onto the housing in which the leads have free end portions preformed to angle away from the target plane, and a biasing surface, located on the housing, for biasing the free end portions toward the target plane and into a coplanar state.

DETAILED DESCRIPTION OF THE PREFERRED EMBODIMENT

Figure 1:
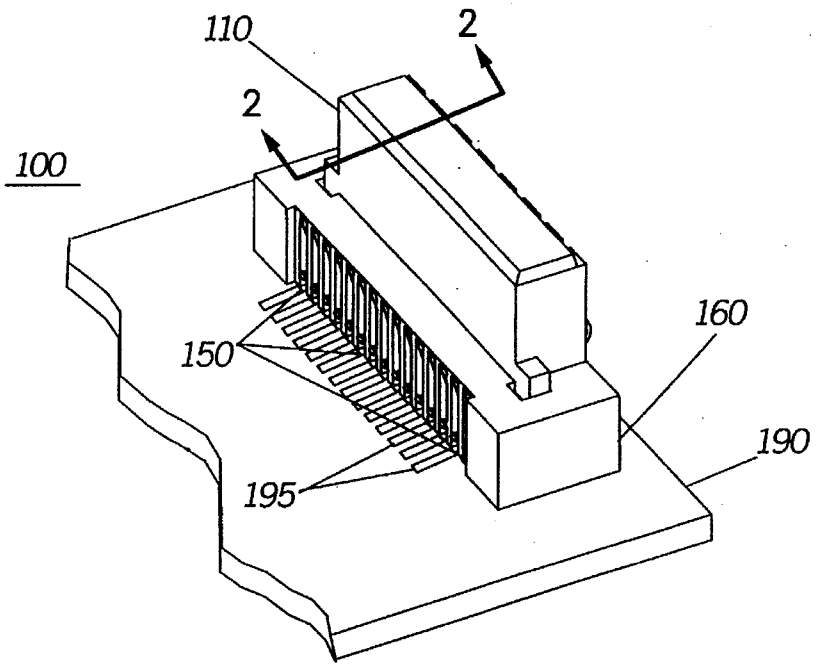
FIG. 1 is a perspective view of an assembled surface mountable connector mounted on a printed circuit board, in accordance with the present invention.
Figure 2:
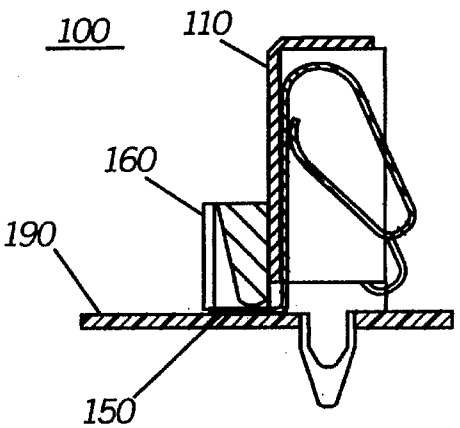
FIG. 2 is a cross sectional view of the connector and printed circuit board of FIG. 1.

Referring to FIG. 1, a surface mountable connector 100 mounted to a printed circuit board 190 is shown as an example of a surface mountable package made in accordance with the present invention. The printed circuit board 190 is part of a portable radio (not shown) which contains electronic circuitry (not shown) to communicate over a radio frequency channel. The connector 100 consists of three main elements: a connector housing 110, flexible cantilever interface leads 150, and a correction bar 160 mounted onto the housing 110 and over the leads 150. The connector 100 is used in the manufacturing of electronic devices, such as radios and other communication devices, and functions as part of the general electronic circuitry found in these devices. The connector 100 is designed to be surface mounted onto a circuit carrying substrate, such as the radio printed circuit board 190, so that the leads 150 engage interface connections 195 located on the surface of the circuit substrate 190, thereby pro-riding electrical coupling between the connector 100 and the circuitry (not shown) on the substrate 190.

Figure 3:
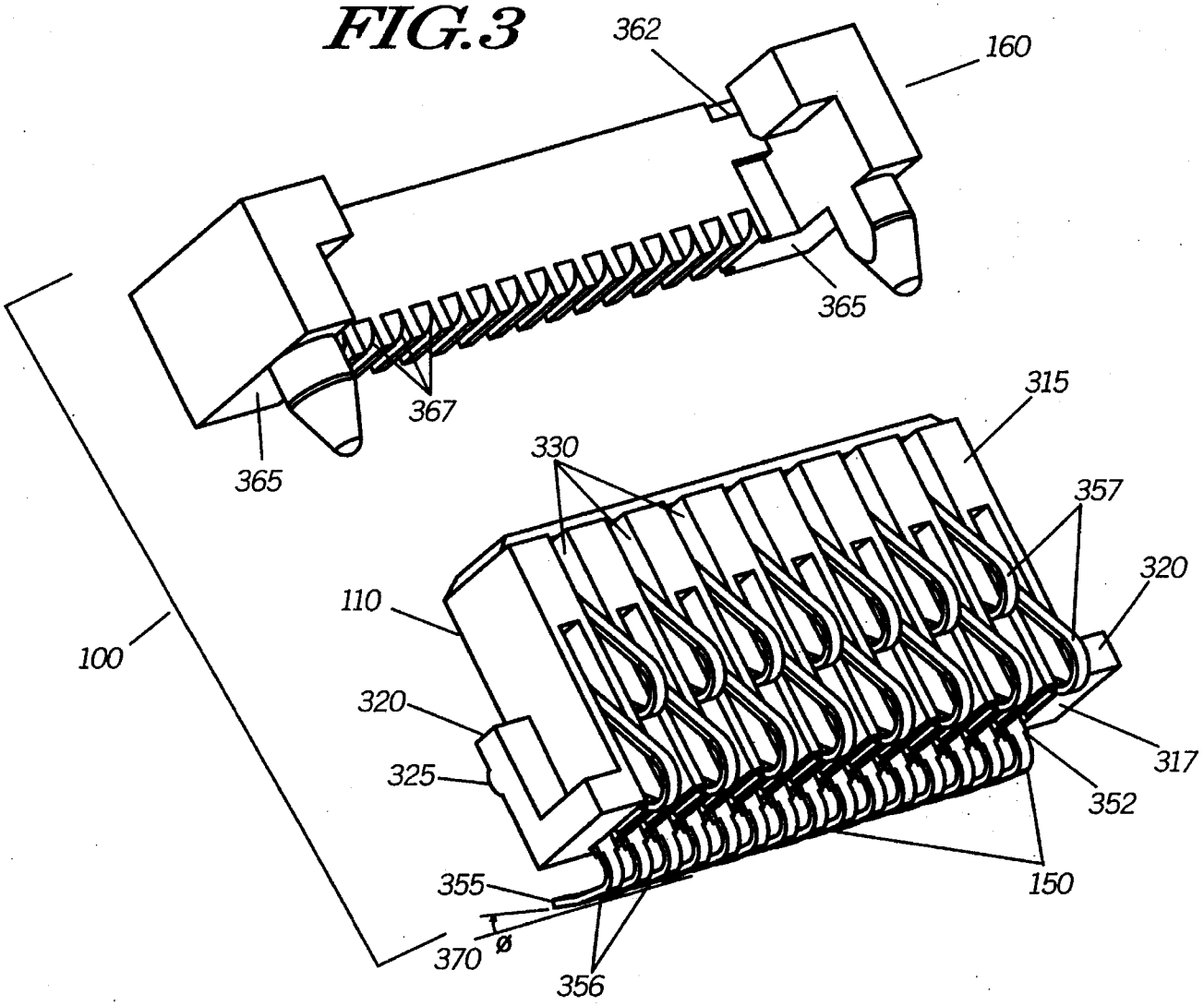
FIG. 3 is an exploded perspective view of the connector in accordance with the present invention.

FIG. 3 is an exploded view of the connector 100 showing the correction bar 160, and the connector housing 110 with its connection interface 315 and installed leads 150 in accordance with the present invention. The connector housing 110 provides structural support for the cantilever leads 150 and also functions as an insulator which separates the leads 150. The housing 110 is preferably formed from plastic or other suitable insulating material. The housing 110 has a general rectangular shape with planar surfaces on all sides with the exception of guide rails 320 on two opposing sides of the housing 110. The guide rails 320 are in the form of integral L-shaped protrusions extending from the surface of the housing 110. The guide rails 320 aid in mounting the correction bar 160 onto the housing 110, and also in retaining the correction bar 160 to the housing 110. Small projections 325 on the guide rails 320 function as retainers, which help in securing the correction bar to the housing 110. The housing 110 has a planar lower surface 317 which is the mounting surface for the connector 100. Slots 330 extend through the housing 110 from the connector interface surface 315 to the mounting surface 317, for the purpose of accommodating the leads 150.

The leads 150 are mounted within the slots 330 of the housing 110 with portions of each lead 150 exiting the mounting surface of the housing 110. Thus, each lead 150 has a fixed end 352 attached to the housing 110 and a free end portion 355 extending beyond the mounting surface of the housing 110. In the preferred embodiment, each lead 150 is extended within the connector 100 to also function as an interface element 357 for electrically connecting a corresponding mating connector (not shown). The lower surface 356 of the free end portion of each lead forms the contact surface 356 which engages one of the interface connection 195 on the circuit carrying substrate 190 (see FIG. 1) when the connector 100 is installed in an electronic device. One aspect of the present invention is that the contact surfaces 356 of the leads 150 are substantially coplanar in a target plane 370. In the preferred embodiment, this target plane 370 is below and parallel to the mounting surface 317 of the connector 100. Before being mounted to the housing 110, the leads 150 are first preformed to angle away from the target plane 370. For example, FIG. 3 shows the preformed free end portions 355 at an angle theta ($\phi$) from the target plane 370. Preforming the leads 150 include deliberately deforming the free end portions 355 to induced a resistive force opposite to the direction of deformity. The leads 150 are oriented within the housing 110 such that the free end portions 355 are angled toward the housing 110 and away from target plane 370.

The correction bar 160 is a C-shaped member which fits around the periphery of the housing 110 and is retained to the housing 110 by a combination of integral snapping features 362 located on the correction bar and the retainers 325 present on the housing 110. However, any apparatus integral to the surface mountable package and which provides a biasing surface against which the leads can be biased may be a suitable substitute for the correction bar 160. The correction bar 160 has a planar lower surface 365, or biasing surface, which is parallel to the target plane 370, and which extends just beyond the mounting surface 317 of the housing 110. The correction bar 160 mounts onto the housing 110 so as to fully engage the preformed free end portions 355 of the leads 150 with its biasing surface 365. Additionally, the biasing surface 365 has positioning notches 367 distributed along its surface coinciding with the positions of the free end portions 355 of the leads 150, which help to substantially limit the lateral movement of the free end portions 355 of the leads 150.

Figure 4:
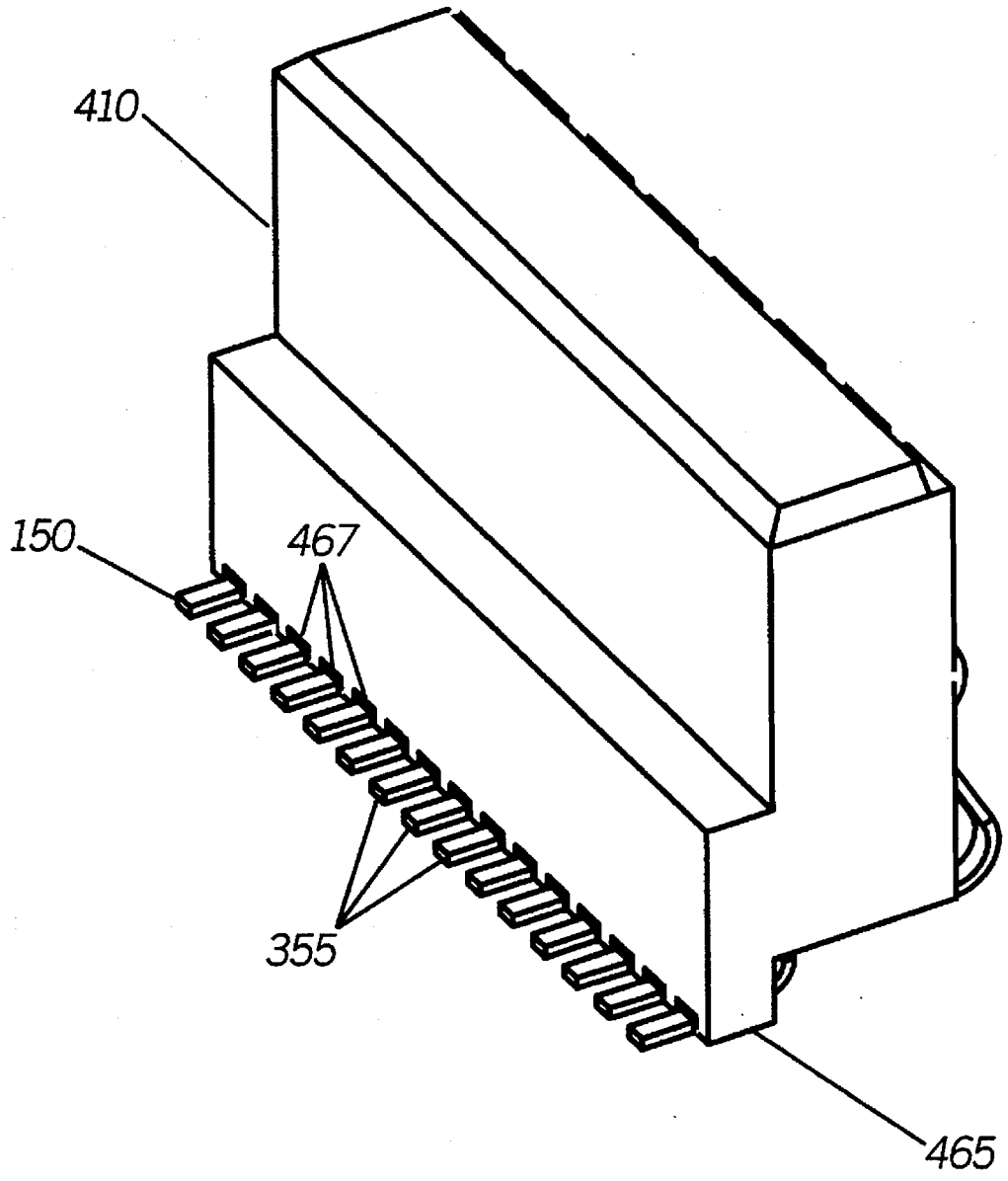
FIG. 4 is a perspective view of a second embodiment of the connector having an integral correction plane in accordance with the present invention.

FIG. 4 shows a second embodiment of the connector housing 410 in which a correction face 465 is integrally formed on the connector housing 410, which functions similar to the biasing surface 365 of the correction bar 160 on the preferred embodiment (see FIG. 3). The correction face 465 also includes positioning notches 467 along its surface. As before, preformed leads 150 are mounted within the connector housing 110 such that the free end portions 355 angle toward the correction plane 465. The free end portions 355 are forcibly mounted against the correction plane 465 such that the free end portions 355 are biased against the correction plane 465 into a coplanar state.

Referring again to FIG. 3, showing the preferred embodiment, a simple assembly operation is achievable. The flexible cantilever leads 150 are inserted into the integral slots 330 of the connector housing 110 such that the angled free end portions extend away from the connector. The correction bar 160 slides along the guide rails 320 of the connector housing 110 and is secured to the housing 110 with a combination of the retainers 325 on the housing 110 and the snapping features 362 on the correction bar 160. The mounting action of the correction bar 160 also forces the biasing surface 365 against the angled free end portions 355 of the leads 150, thereby biasing the free end portions 355 against the biasing surface 365 of the correction bar 160 such that the contact surfaces 356 of the free end portions 355 of the leads 150 are uniformly forced toward the target plane 370 and into a coplanar state.

In accordance with the present invention, the connector 100 represents a significant step towards addressing the problems associated with a lack of lead coplanarity on surface mounted leaded packages. By incorporating coplanarity adjustment features directly on the leaded package, the use of expensive and cumbersome equipment to assure coplanarity is avoided. Accordingly, more leaded packages can be adapted for surface mounting, thus promoting the use of surface mounting in manufacturing which in turn can result in increased manufacturing efficiency improved product quality.

What is claimed is:

1. A surface mountable connector having a plurality of leads coplanar in a target plane, comprising:

a housing having a connector interface surface and a mounting surface, the housing having lead slots extending to the mounting surface, the housing having an integral guide rail and a first retainer portion;

a plurality of leads mounted within the lead slots, said plurality of leads having free end portions exiting the mounting surface of the housing, said free end portions being preformed to angle away from the target plane and toward the mounting surface;

a correction bar mounted on said housing along the guide rail, the correction bar having a second retainer portion that cooperates with the first retainer portion to secure the correction bar to the housing, the correction bar engaging said free end portions and biasing said free end portions toward the target plane to form a coplanar contact surface for mounting the connector, said correction bar having positioning notches for limiting lateral movement of said free end portions;

wherein at least one of the first and second retainer portions comprises a protrusion that engages the other retainer portion in a snap fit arrangement.

2. A surface mountable connector having a plurality of leads coplanar in a target plane as defined in claim 1, wherein the integral guide rail has a protrusion thereon that forms the first retainer portion.

* * * * *